US005241891A

United States Patent [19]

Hayes et al.

[11] Patent Number: 5,241,891

[45] Date of Patent: Sep. 7, 1993

[54] PHASEABLE LINK CARRIER FOR EXPLOSIVE CHARGE

[75] Inventors: Scott L. Hayes, Burleson; Michael Montgomery, Stephenville, both of Tex.

[73] Assignee: Goex International, Inc., Cleburne, Tex.

[21] Appl. No.: 946,547

[22] Filed: Sep. 17, 1992

[51] Int. Cl.[5] ..... E21B 43/117

[52] U.S. Cl. ..... 89/1.15; 175/4.6

[58] Field of Search ..... 89/1.15; 102/306; 175/4.6

[56] References Cited

U.S. PATENT DOCUMENTS

| | | | |
|---|---|---|---|
| 2,799,224 | 7/1957 | Long | 89/1.15 |
| 2,927,534 | 3/1960 | Le Bus | 89/1.15 |
| 2,960,930 | 11/1960 | Bell | 89/1.15 |
| 3,100,443 | 8/1963 | Pohoriles | 89/1.15 |
| 4,502,550 | 3/1985 | Ibsen | 175/4.6 |
| 5,007,486 | 4/1991 | Ricles | 175/4.6 |

*Primary Examiner*—David H. Brown

*Attorney, Agent, or Firm*—Arthur F. Zobal

[57] ABSTRACT

The explosive charge carrier has first and second ends and an intermediate opening formed therethrough between the two ends for holding an explosive charge. The first end has an annular groove with a tongue and the second end has a central opening defining an annular wall. Angularly spaced apart slots are formed in the second end from its edge. Two slots are formed through the annular wall on opposite sides thereof. A clip member having a loop-shaped portion with two legs with inward extending portions is provided for insertion of the inward extending portions into the central opening by way of the two slots for location in the annular groove of the first end of an identical carrier inserted into the central opening to secure the two carriers together with the tongue of the identical carrier located in a selected one of the slots formed in the annular wall.

2 Claims, 2 Drawing Sheets

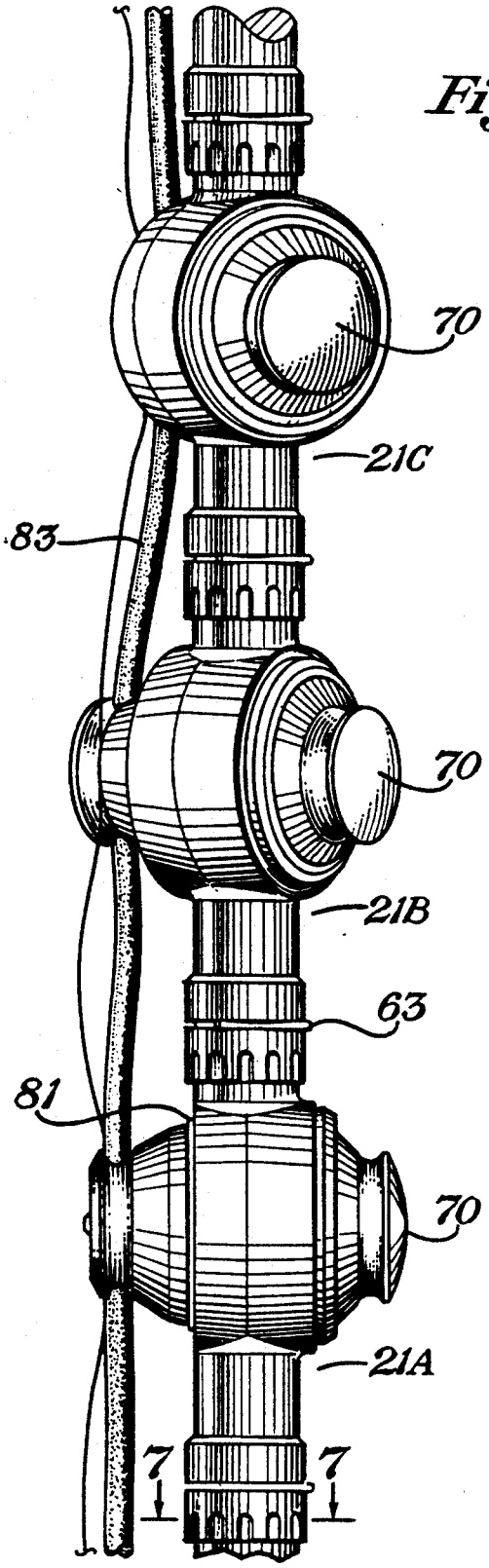
Fig. 6
Fig. 4
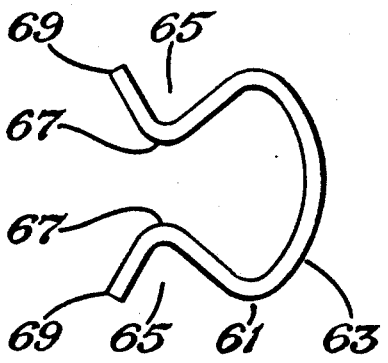
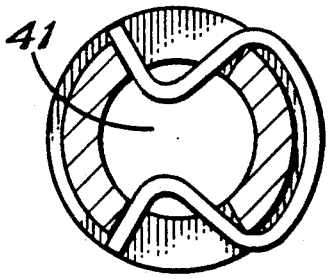
Fig. 5
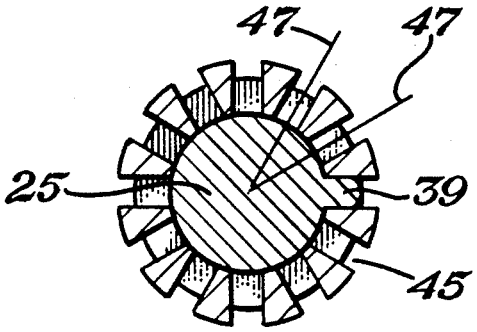
Fig. 7

PHASEABLE LINK CARRIER FOR EXPLOSIVE CHARGE

BACKGROUND OF THE INVENTION

1. Field Of The Invention

The invention relates to an apparatus for supporting an explosive charge in a borehole for perforating well casing.

2. Description of the Prior Art

Well perforating apparatuses typically utilize shaped explosive charges for perforating well casing. They are mounted to a carrier which is lowered into a borehole and exploded at the desired positions and depths for perforating the well casing.

Heretofore, assembly of the charges to the carrier has been time consuming and difficult, particularly when the charges are to be located at different angles in the borehole. U.S. Pat. Nos. 4,852,495 and 4,881,445 disclose shaped charges mounted to one type of carrier.

SUMMARY OF THE INVENTION

It is an object of the invention to provide a carrier for explosive charges which is easy to assemble in the field and allows the charges to be located at different angles relative to each other along the axis of the borehole.

It is a further object of the invention to provide an explosive charge carrier that can support individual charges or a strip charge at different angles in the borehole.

The explosive charge carrier of the invention comprises a body with first and second ends and an intermediate opening formed therethrough for receiving and holding an explosive charge. The first end has a groove formed in its outer wall and a tongue extending in the direction of the length of the body. A central opening is formed in the second end defining an annular wall. A plurality of slots are formed in the annular wall at angularly spaced apart positions relative to the axis of the annular wall. Slot means is formed through the annular wall between the slots and the intermediate opening. Clip means is provided for location in the central opening by way of said slot means whereby an identical carrier may have its first end located in the central opening with its tongue located in a selected one of the slots and the clip means located in its groove to couple the two carriers together with their charges located at different angular positions relative to the central axis of the two carriers.

In the embodiment disclosed, the groove is a circumferential groove. The slot means comprises two slots formed through the annular wall on opposite sides thereof and the clip means comprises a clip member having a loop option with two legs which extend toward each other and then away from each other for location into the central opening by way of the two slots with the loop portion located on the outside of the annular wall and the legs located in the groove of the other carrier.

BRIEF DESCRIPTION OF THE DRAWINGS

FIG. 4 is a plan view of a spring clip used to secure two link carriers together.

FIG. 5 is a cross-sectional view, similar to that of FIG. 3, of the link carrier, illustrating the legs of the clip of FIG. 4 located in the central opening by way of the two slots.

FIG. 6 illustrates three link carriers coupled together with their charges located in different angular positions relative to the axis thereof.

FIG. 7 is a cross-sectional view of FIG. 6 taken along the lines 7—7 thereof.

DESCRIPTION OF THE PREFERRED EMBODIMENTS

Figure 1:
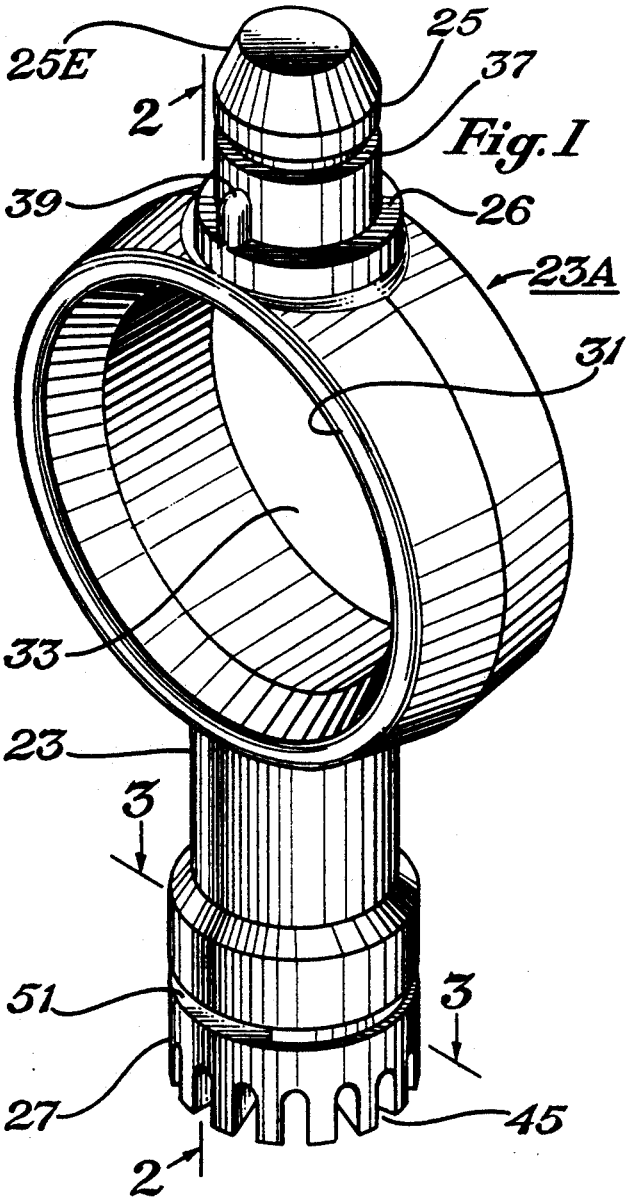
FIG. 1 is an isometric view of one link of the explosive charge carrier of the invention.
Figure 2:
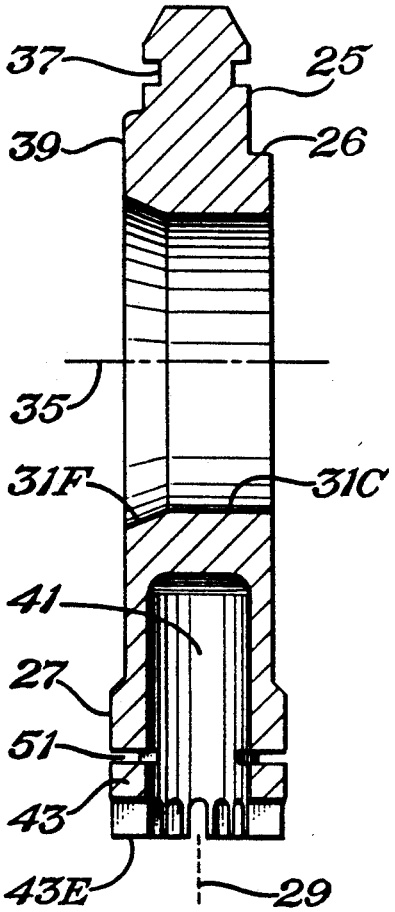
FIG. 2 is a cross-section of FIG. 1, taken along the lines 2—2 thereof.
Figure 3:
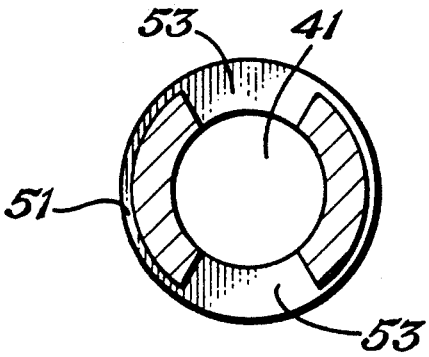
FIG. 3 is a cross-section of FIG. 1, taken along the lines 3—3 thereof.
Figure 8:
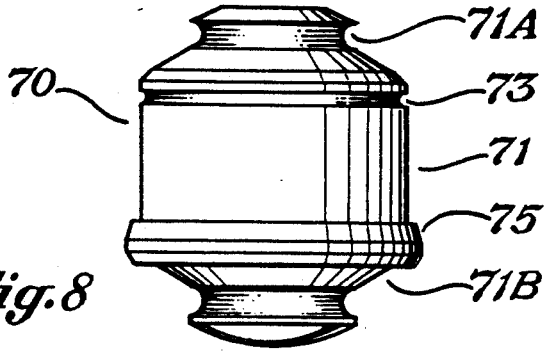
FIG. 8 is a plan view of an explosive charge.

Referring now to the drawings: the link carrier of the invention is identified by reference numeral 21A. It comprises a metal body 23 having two cylindrical ends 25 and 27 with a central axis 29 and an intermediate large diameter annular wall 31 forming an intermediate opening 33 with its axis 35 transverse to the axis 29. The opening 33 is used to hold an explosive charge as shown in FIGS. 6 and 8. The end 25 has an annular or circumferential groove 37 formed in its outer wall and a tongue member 39 located between the groove 37 and the opening 33 and extending in a direction parallel to the axis 29.

The end 27 has a larger diameter than the end 25 and has a central cylindrical opening 41 formed therein defining an annular wall 43. The inside diameter or the opening 41 is larger than the outside diameter of the end 25. The annular wall 43 has a plurality of slots 45 formed therein from its end 43E at angularly spaced apart positions relative to the axis 29. Each of the slots 45 has a width sufficient to receive a tongue 39 of an identical link carrier. In the embodiment disclosed, there are twelve slots 45. Adjacent radial lines 47 from the axis 29, to the centers of adjacent slots 45 form an angle of 30 degrees. It is to be understood that more or less than twelve slots 45 may be employed. Formed in the wall of the end 27 is an annular or circumferential groove 51 with two side slots 53 formed through the wall 43 on opposite sides and extending to the central opening 41.

Also provided is a metal spring clip 61 having a loop-shaped portion 63 and two legs 65 with portions 67 extending toward each other and portions 69 extending away from each other. The legs 65 can be spread apart to allow the loop-shaped portion 63 to be fitted in the groove 51 and then released to allow the leg portions 65 to be located in the central opening 41 by way of the slots 53 as shown in FIG. 5.

In FIG. 6 there is shown three identical link carriers 21A, 21B, and 21C coupled together for supporting there shaped charges 70 at different angular positions. Two link carriers may be coupled together by inserting the end 25 of one carrier 21A into the opening 41 of the other carrier 21B with its tongue 39 located in a selected one of the slots 45 of the carrier 21B to align the axes 35 of the charge carrying openings 33 or to locate them at different angles relative to each other. When the end 25 of the carrier 21A is fully inserted into the opening 41 of the carrier 21B, its shoulder 26 will abut against the end 41E of the carrier 21B and its groove 37 will be located in line with the groove 51 and slots 53 of the carrier 21B. The two carriers then can be secured together by locating the leg portions 67 of the clip 61 into the opening 41 of the carrier 21A and hence into the groove 37 of the carrier 21B to releasably lock the two carriers together.

The explosive charges 70 each has a cylindrical wall 71 with an annular or circumferential groove 73 at one end 71A and an annular shoulder 75 at the other end 71B. The inside of the annular wall of the carrier forming the opening 33 has a flared end 31F and a cylindrical portion 31C for snugly receiving the cylindrical wall 71 of a charge 70. A charge 70 is inserted into and held in the opening 33 of a carrier by inserting its end 71A through the opening 33 from the flared end 31F until the shoulder 75 engages the flared surface 31F and the groove 73 is located beyond the annular wall. A C-shaped or split ring spring member 81 (See FIG. 6) then is located in the groove 73 to releasably lock the charge 70 in the opening 33.

Member 83 is a detonating cord that extends to all of the charges 70.

The link carrier of the invention will hold and support a steel high-performance shaped charge or an aluminum "expendable" shaped charge. In addition, the link carriers also will hold and support a strip charge.

In one embodiment the link carrier 21A may have a length from end 25E to end 45E of 3.70 inches and an opening 33 with a diameter of 1.31 inches.

We claim:

1. An explosive charge carrier, comprising:

a body having a given length with first and second ends and an intermediate opening formed between said first and send ends for receiving and holding an explosive charge, said body having a central axis extending between said first and second ends, said first end having a groove formed in its outer wall and a tongue extending in the direction of the length of said body, a central opening formed into said second end along said central axis and extending from said second end toward said first end to a given position defining an annular wall at said second end, a plurality of slots formed in said annular wall at angularly spaced apart positions relative to said central axis, slot means formed through said annular wall, and clip means having a portion adapted to be located in said central opening by way of said slot means whereby an identical explosive charge carrier may have its first end located in said central opening with its tongue located in a selected one of said slots and said portion of said clip means located in its groove by way of said slot means to secure two explosive charge carriers together with their intermediate openings located at different angular positions relative the central axes of the two explosive charge carriers.

2. The explosive charge carrier of claim 1, wherein:

said groove formed in said outer wall of said first end comprises an annular groove, said slot means comprises two slots formed through said annular wall on opposite sides of said annular wall, said clip means comprises a loop-shaped spring clip member having a loop portion and two legs with inward extending portions which extend toward each other and end portions which extend away from each other for location of said inward extending portions into said central opening whereby said loop portion of said clip member may be located on the outside of said annular wall and said inward extending portions may be located in the annular groove of an identical explosive charge carrier when its first end is located in said central opening.

* * * * *